United States Patent [19]

Vatant

[11] Patent Number: 4,946,142

[45] Date of Patent: Aug. 7, 1990

[54] PIVOTING DEVICE FOR LADLES

[75] Inventor: Robert Vatant, Saint Chamond, France

[73] Assignee: CLECIM, Courbevoie Cedex, France

[21] Appl. No.: 261,964

[22] PCT Filed: Jan. 5, 1988

[86] PCT No.: PCT/FR88/00006

§ 371 Date: Sep. 6, 1988

§ 102(e) Date: Sep. 6, 1988

[87] PCT Pub. No.: WO88/04969

PCT Pub. Date: Jul. 14, 1988

[30] Foreign Application Priority Data

Jan. 6, 1987 [FR] France ..... 87 00056

[51] Int. Cl.[5] ..... B22D 41/00

[52] U.S. Cl. ..... 266/276; 164/335

[58] Field of Search ..... 164/437, 438, 335, 336, 164/337; 222/591, 604, 607; 266/236, 240, 276

[56] References Cited

U.S. PATENT DOCUMENTS

| | | | |
|---|---|---|---|
| 3,578,063 | 5/1971 | Festivalnaya et al. | 164/438 |
| 3,773,228 | 11/1973 | Koch et al. | 164/438 |
| 4,270,738 | 6/1981 | Dangeleit et al. | 266/276 |
| 4,286,738 | 9/1981 | Blum | 164/438 |
| 4,603,841 | 8/1986 | Scheurecker et al. | 164/437 |
| 4,751,956 | 6/1988 | Benedetti | 164/335 |

*Primary Examiner*—Richard K. Seidel

*Attorney, Agent, or Firm*—Pollock, Vande Sande & Priddy

[57] ABSTRACT

The pivoting device for ladles used in continuous casting comprises at least one arm extended overhanging from a rotary barrel and comprised of a parallelogram-shaped deformable and articulated assembly comprising two supporting uprights connected to the barrel by parallel rods hinged to the uprights about upper and lower movable pins, and to the barrel (2) about upper and lower fixed pins. The uprights form an outer side movable vertically while remaining parallel to itself by deformation of the parallelogram under the action of at least one lifting jack. The articulations defining the movable pin of the upper rods are provided on a transverse frame extended horizontally and passing outside the ladle between the latter and the barrel, and the two supporting uprights are secured to the transverse frame and form with the latter a rigid fork-shaped seat wherein the ladle is nested.

10 Claims, 4 Drawing Sheets

PIVOTING DEVICE FOR LADLES

FIELD OF THE INVENTION

The present invention relates to the sector of the iron and steel industry, and its subject is a casting-ladle turntable used particularly in installations for the continuous casting of steel.

BACKGROUND OF THE INVENTION

In this type of installation, the ladles containing the molten metal coming from the steel plant are brought near to the casting installation by means of a transport carriage or a travelling crane and are placed above a tundish, into which the molten metal pours via a taphole. The molten metal subsequently passes from the tundish to the bottomless mold, where the continuous strip of metal, namely a slab or a bar, is formed.

In order to make it easier to replace the ladles and reduce the downtime as much as possible, an appliance called a "ladle turntable" is often used as a ladle support.

Such appliances are known. They comprise at least one arm extending in an overhung manner from a barrel mounted rotatably about a vertical axis on a stationary base, for example the supporting stand of the installation. Each arm can support a ladle and, as a result of rotation, move it from a charging and discharging position into a casting position above the tundish.

The turntable is often equipped with two diametrically opposite arms, so that, while one ladle located above the tundish pours the steel which it contains, the previously emptied ladle can be removed from the other arm in order to replace it with a new full ladle.

In general, the taphole closed by means of a spout is extended downwards by a casting pipe, the function of which is to protect the jet of steel between the ladle and tundish from contact with the air and therefore from oxidation.

The protective devices are generally either a refractory pipe attached or retained under the ladle or a skirt made of asbestos or similar material, in which an inert atmosphere is maintained.

Because the ladle is brought above the tundish and then emptied as a result of the rotation of the arm of the support about its vertical axis, it was thought expedient to equip the ladle supports with lifting devices which make it possible to release the casting pipe during changes of ladles or tundishes. Lifting is also necessary when, in order to unblock the spout closing the taphole, it is necessary to blow into it, by means of a lance, pressurized oxygen which burns the steel solidified in the spout orifice.

The known devices for lifting the ladle-supporting arms can be of the hydraulic or the electromechanical type.

In devices of the mechanical type, lifting is brought about by means of elements of the winch and block and tackle, screws and nuts, connecting rod or crank type. These devices are heavy and bulky, and they sweep across a large space through the rotation of the turntable, thus creating dangerous zones at the workstations. Furthermore, they generally comprise a certain number of joints and guides which are exposed to the splashes of steel, and which therefore require frequent and difficult maintenance.

Moreover, the guides projecting above the arms require a greater lifting height on the crane and therefore a proportionate building height.

In devices of the hydraulic type, lifting is brought about by means of jacks. These devices are simpler and generate fewer stresses than the mechanical devices.

In this case, the lifting of the ladle is controlled by at least one hydraulic jack bearing on the supporting arm, the latter being mounted pivotally on the barrel about a horizontal axis.

The ladle is equipped with two journals engaging into suspension members which allow actuation by means of the travelling crane, and which rest on bearing parts formed at the end of the supporting arm and often having the form of a trapezoidal cup, into which fit the lower parts, of corresponding forms, of the suspension members. Thus, if the bearing parts are fastened rigidly to the end of the supporting arms, the pivoting of these during lifting determines a change of orientation of the supporting members and consequently an oscillation of the ladle about its journals. Consequently, it is often considered preferable to provide the bearing parts on two supporting stays connected to the barrel by means of an articulated system constituting a deformable parallelogram, of which they form an outer side moveable parallel to itself. For this purpose, each supporting stay is articulated about horizontal axes, respectively on the end of the supporting arm and on a connecting rod parallel to the supporting arm and articulated on the base, the vertex of the deformable parallelogram being formed by the respectively stationary and moveable axes of articulation of the supporting arm and of the retaining connecting rod respectively on the base and on the two supporting stays.

In such arrangements, which are described, for example, in EP-A-0,206,169 or FR-A-2,234,946, the lifting force is exerted on the supporting arm, which is therefore subjected to bending, and the force required from the jack is greater than the weight of the charge. For this reason, in order to support the articulated assembly more effectively during lifting, the latter is generally produced by means of two set-apart and synchronized jacks, each acting on one side of the supporting arm.

SUMMARY OF THE INVENTION

The object of the invention is a device of the deformable parallelogram type, but simpler, less heavy and less bulky than most of the known devices. Furthermore, the rigidity of the members supporting the ladle is increased, and it is possible to carry out the lifting by means of a single lifting jack, the force generated being utilized more efficiently. Moreover, the device according to the invention assists the protection of the various mechanical and hydraulic members against splashes of steel, while at the same time having absolute accessibility allowing easy and effective maintenance.

The ladle turntable according to the invention is therefore of the type comprising a barrel mounted rotatably on a stationary base and at least one arm extending in an over-hung manner and composed of an articulated assembly in the form of a deformable parallelogram comprising two supporting stays located on either side of the ladle and connected to the barrel by means of a set of respectively upper and lower parallel connecting rods connected respectively to the two stays and to the barrel by means of joints defining four horizontal axes constituting the vertices of the deformable parallelogram, the said stays forming a moveable outer side capable of moving vertically, whilst remaining parallel to itself, as a result of the deformation of the parallelogram under the action of at least one lifting jack.

According to the invention, the joints defining the moveable axis of the upper connecting rods are formed on a transverse frame extending horizontally and passing on the outside of the ladle between the latter and the barrel, and the two supporting stays are fastened rigidly to the said transverse frame and form with the latter a rigid fork-shaped chair into which the ladle engages.

In relation to the other known arrangements with a deformable parallelogram, the invention therefore has the particular feature of placing the moveable upper axis on the outside of the ladle between the latter and the barrel, the two stationary and moveable lateral sides of the parallelogram being oriented obliquely, so that the upper moveable axis of the parallelogram is substantially vertically aligned with the lower stationary axis. As a result of this arrangement, the supporting chair can bear directly on the lifting jack or lifting jacks, the latter being interposed between the barrel and the transverse frame and being directed in a substantially vertical axis, at the same time bearing respectively on the transverse frame near the upper moveable axis and on the barrel near the lower stationary axis.

Such an arrangement makes it possible, in particular, to carry out the lifting of the ladle by means of a single jack located in the vertical mid-plane of the chair and bearing at the center of the transverse frame of the supporting holder.

Furthermore, because the weight of the chair supporting the ladle is exerted directly on the jack or jacks, the upper and lower connecting rods forming the substantially horizontal sides of the parallelogram perform only a stabilizing function in order to maintain the chair in the three axes and are subjected solely to compressive and tensile forces. Furthermore, the size of the jack or jacks is governed directly by the mass of the ladle, and its stroke is substantially equal to the lifting stroke required.

In addition, the load can be measured directly either by means of a balance interposed between the lifting jack and the barrel or simply by measuring the pressure of the jack.

BRIEF DESCRIPTION OF THE DRAWINGS

Several embodiments of the invention will now be described with reference to the accompanying drawings.

DESCRIPTION OF PREFERRED EMBODIMENTS

Figure 1:
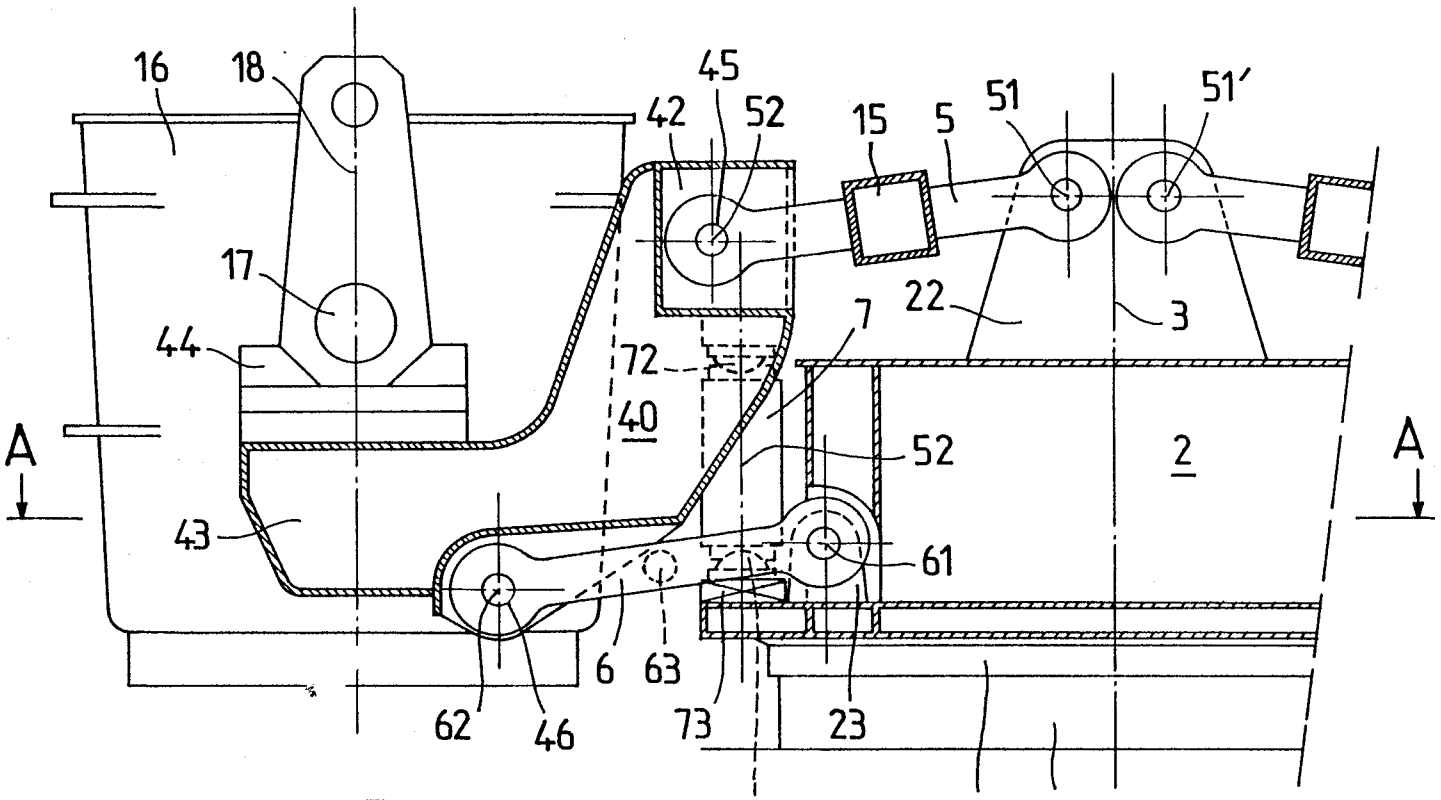
FIG. 1 is a side view of a ladle turntable arm according to the invention.
Figure 2:
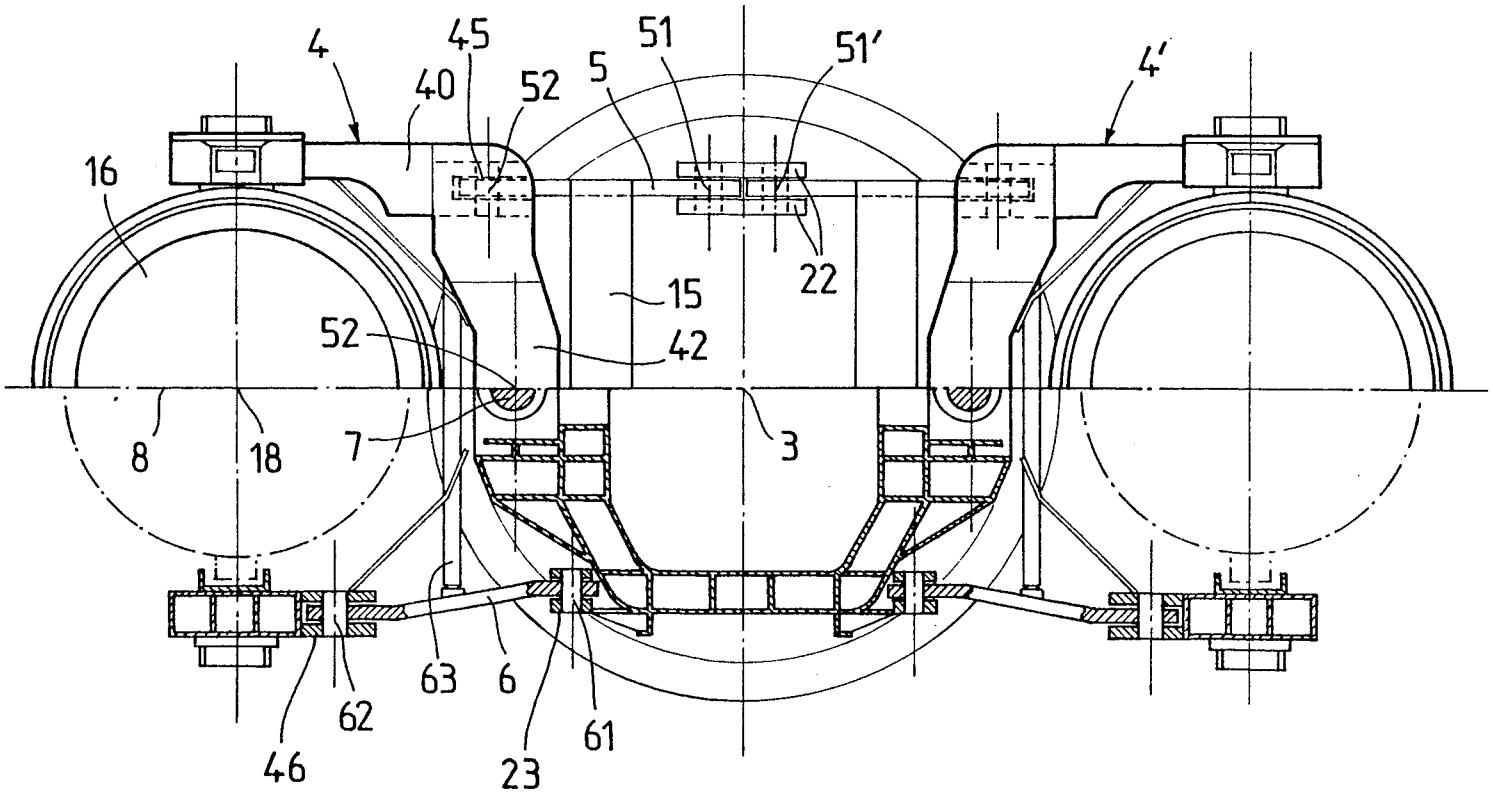
FIG. 2 shows, in its upper part, a plan half-view of the turntable and, in its lower part, a half-section according to line A—A of FIG. 1.

The ladle turntable illustrated in FIGS. 1 and 2 comprises a barrel (2) mounted rotatably about a vertical axis on a stand or base (1) anchored to the foundation block. The rotation of the barrel is controlled by a motor and is transmitted by gears (not shown) to a roller orientation or swivel ring (21) fixed to the barrel (2).

This turntable is of the type comprising two ladle-supporting arms (4, 4') extending in an overhung manner from the barrel (2) symmetrically on either side of the axis (3) of the rotary barrel (2). As can be seen in the Figure, however, each supporting arm (4) comprises a massive supporting chair (40) set apart from the barrel and connected to the latter simply by means of two pairs of respectively upper and lower parallel connecting rods (5, 6). The chair (40) for supporting the casting ladle (16) comprises two stays (41) located on each side of the ladle (16) and connected rigidly to one another by means of a horizontal beam or transverse frame (42), so as to constitute a rigid fork-shaped unit having two free ends (43).

Provided at each of these free outer ends (43) are lateral bearing members (44) which form a cradle and on which the ladle rests by means of two diametrically opposite suspension axles or journals (17).

According to a known arrangement, the journals (17) engage into suspension members (19) equipped, in their lower part, with a bearing surface of trapezoidal form which fits into a surface of the same form recessed in the corresponding cradle (44), so as to ensure the wedging of the ladle (16).

On the outside, the upper and lower connecting rods (5, 6) for guiding and retaining the chair (40) are articulated respectively on the transverse frame (42) and on the free ends (43) of the two stays (41) about joints (45, 46) defining respectively an upper moveable axis (52) and a lower moveable axis (62).

On the inside, the upper and lower connecting rods (5, 6) are articulated on the barrel (2) about two respectively upper and lower stationary axes (51, 61). The two stationary axes of articulation (51, 61) are defined by bearings carried by the barrel (2) and formed respectively on flanges (22) fastened to the upper part and in the axis of the barrel (2) and on flanges (23) fastened to the lower part in the region of the swivel ring (21).

The various joints (45, 46, 22, 23) are integral parts of the connecting rods and of the barrel, the attached components being simple short bearings.

The four axes (51, 52, 61, 62) are located at the vertices of a deformable parallelogram, each stay (41) of Which therefore forms a moveable outer side opposite the stationary inner side defined by the upper and lower axes (51, 61). The upper and lower connecting rods (5, 6) form the other two respectively upper and lower sides of the parallelogram.

The other two sides are formed, on the one hand, by the lower connecting rods (6) forming the lower side of the parallelogram and, on the other hand, by the upper connecting rods (5) forming its upper side.

It can be seen that the orientation of the lateral sides of the parallelogram and the length of the connecting rods are determined so that the moveable upper axis (52) of the parallelogram is arranged substantially vertically in line with the lower stationary axis (61).

In the preferred embodiment illustrated in the drawings, the movement of lifting the ladle is generated by a single hydraulic jack (7) bearing, on the one hand, on the barrel (2) between the two lower connecting rods (6) and, on the other hand, on the ladle-supporting chair (40) in the middle of the transverse frame (42).

In such an arrangement, the lifting jack can therefore be oriented in a substantially vertical direction. The necessary changes in orientation during lifting are made possible by interposing articulated bearing members (71, 72) between the two elements of the jack (7) and the barrel (2) and the frame (42), respectively. Ball-type bearing members can be used, but an articulation about an axis parallel to the axes of the parallelogram will be sufficient.

As can be seen, the jack (7) thus directly supports the weight of the ladle (16), to which is added that of the chair (40).

Consequently, no gearing-down effect increases the load exerted on the jack, the movement of which is substantially equal to that of the ladle, and this makes it possible, in particular, to use a single jack, the size and stroke of which are governed directly by the mass to be lifted and by the lifting stroke required.

The hydraulic circuit is simplified because the lifting jack can be a simple plunger jack, the descending return being obtained reliably, even without load, as a result of the deadweight of the chair (40) and connecting rods (5, 6).

The supporting chair (40) may comprise a mechanically welded unit forming a highly rigid fork simply retained by means of the connecting rods (5, 6), so as to move parallel to itself. The connecting rods (5, 6) are subjected solely to tension or compression and, moreover, can be relatively short, even if the stationary upper axis (51) is located very near the axis of the barrel (2). The chair (40) itself is subjected to only little bending.

The two bearing members (44) of the journals (17) are maintained horizontal by means of the transverse frame (42) associated with a torsion box (15) extending horizontally beween the two upper connecting rods (5), to which it is fastened rigidly. Moreover, the two lower connecting rods (6) can likewise be fixed to one another by means of a connecting bar (63).

Thus, any imbalance is absorbed by an element not liable to wear or maintenance, as would be the conventional dynamic devices, such as pinions, hydraulic distributor racks, screws, nuts, etc.

Maintaining the parallel alignment of the corresponding elements on the two sides of the parallelogram generates a torsional moment which the box (15) can be made to support essentially if the dimensional characteristics of the latter are adapted accordingly, the same applying to the transverse frame (42) which supports the lifting force, particularly when a single jack is used.

Since, the second arm (4') of the turntable extending symmetrically on the other side of the axis (3) of the rotary barrel (2) is arranged in the same way, and it was considered unnecessary to illustrate it completely in the drawings.

Figure 3:
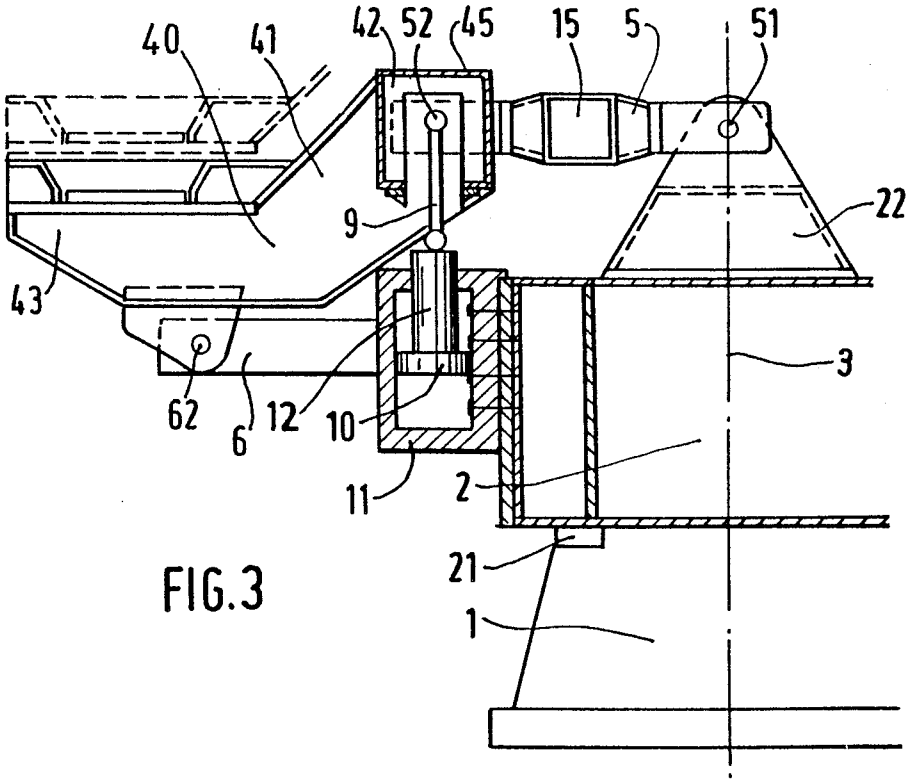
FIGS. 3 and 4 show alternative embodiments of the turntable according to the invention.

FIG. 3 shows a second embodiment of the turntable according to the invention.

The difference from the turntable described above is that the jack (7) is fastened rigidly directly to the rotary barrel (2). The thrust of this jack (7) is thus transmitted to the supporting chair (40) by means of a compression connecting rod (9) articulated at its two ends on the chair (40) and on the jack (7) respectively.

This particular embodiment of the lifting device results in better distribution for the transmission of forces in the elements of the turntable. The hydraulic circuits can then be composed of rigid piping, and the assembly comprising the hydraulic lifting device, especially the rod (12) of the jack, the sealing means and the weighing equipment, can be protected particularly effectively against the splashes of steel.

Figure 4:
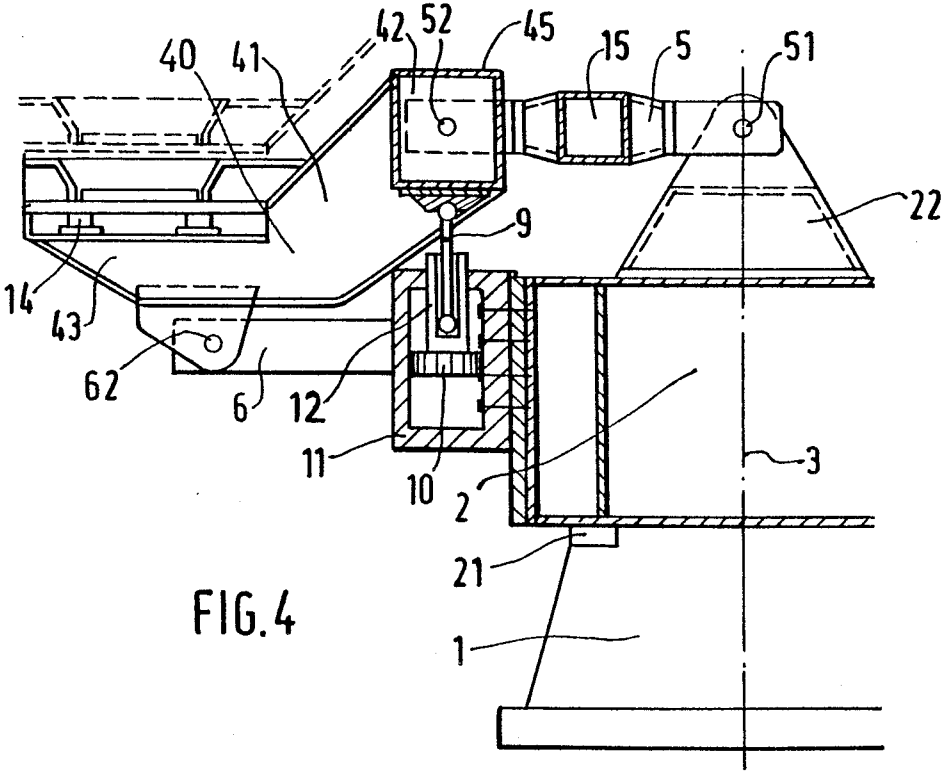

FIG. 4 shows a third embodiment of the turntable. Here the compression connecting rod (9) is articulated at its upper end on the transverse frame (42) and at its lower end directly on the piston (10) of the jack (7) passing into an axial bore in the rod (12) and allowing the play necessary for orientation of the connecting rod (9). The rod (12) thus serves only for guidance and sealing and is subjected to very little stress, the load being exerted directly on the piston (10).

FIG. 4 also shows a weighing device comprising two sets of balances (14) on each side of the ladle. However, because of the proportionality between the weight of the ladle and the compressive force exerted directly on the jack, this weighing device can very easily be used directly in the region of the lifting jack (7) in a new way.

For example, as shown schematically in FIG. 1, balances (73) could be interposed between the body of the jack (7) and the barrel (2) in the region of the lower bearing member (71).

However, the weight of the ladle could also be determined simply from a measurement of the hydraulic pressure exerted on the jack (7), taking into account the deadweights.

It will be seen that the device according to the invention has the advantage of clearing, in the middle of the rotary barrel (2), a free space in which the main hydraulic control equipment can be installed on a simple floorboard well supported by the barrel (2). Other elements, namely a tank and slide valves, can be installed in an overhung manner under the gangways provided for foot traffic on the side of the turntable, but the entire hydraulic control can also be accommodated in the barrel.

The embodiment of the trunnion just described can have alternative forms, without departing from the scope of protection defined by the claims.

For example, it is particularly expedient to use a single jack for lifting the supporting arm of the ladle, thereby avoiding the problems of hydraulic synchronization which arise in all hydraulic devices with several jacks. However, it would also be possible to provide two jacks (7) acting at the two ends of the transverse frame (42).

It would also be possible to insert between the barrel (2) and the chair (40) a damper which reduces the effects of the depositing shocks on the structure as a whole, the compact and rigid form of the chair moreover making it possible to absorb such shocks more effectively.

It will be seen that the characteristics just described, taken as a whole, make it possible to obtain a simple turntable where it is easy to mount and change the ladles and the weight of which is less than that of most known turntables.

The weight of the casting ladle and of the elements supporting it is directly supported by the lifting means without a gearing-down effect, and the lifting means can comprise a single jack arranged in the vertical midplane of the turntable and directed vertically, in such a way that the load to be lifted and the lifting force are substantially parallel, oppositely directed and of equal intensity, with the exception of the dead masses.

Thus, the unavoidable external forces are not converted into greater internal forces, as occurs with conventional lever-type devices.

Furthermore, the complete accessibility of all the sensitive locations (jacks, connecting rods, torsion boxes) allows easy and effective maintenance of the installation, and all the delicate equipment can easily be protected, for example by means of cowls and/or gunited protections.

I claim:

1. A ladle turntable comprising (a) a stationary base;

(b) a barrel rotatably mounted on said base;

(c) at least one arm extending in an overhung manner from said barrel;

(d) means for rotating said barrel with said at least one arm about a vertical axis;

(e) at least one lifting jack for lifting said at least one arm;

(f) said at least one arm being composed of an articulated assembly in the form of a deformable parallelogram comprising two supporting stays spaced from one another to enable insertion of a ladle between them;

(g) said supporting stays each having a free outer end provided with bearing members for supporting said ladle;

(h) said supporting stays being rigidly fastened to a transverse frame extending horizontally and passing exteriorly of said ladle between said ladle and said barrel, that stays forming with said transverse frame a rigid fork-shaped supporting chair in which said ladle is nested;

(i) said supporting chair being connected to said barrel by upper and lower parallel connecting rods respectively connected to said stays by means of joints defining two respectively upper and lower moveable axes and to said barrel by means of joints defining two respectively upper and lower stationary axes, said two moveable axis and said two stationary axes of articulation constituting vertices of said deformable parallelogram;

(j) said supporting chair bearing directly on said at least one lifting jack, said lifting jack being interposed between said barrel and said transverse frame.

2. A ladle turntable as claimed in claim 1, wherein said at least one lifting jack is directed along a substantially vertical axis.

3. A ladle turntable as claimed in claim 2, wherein said at least one lifting jack bears on said transverse frame near said upper moveable axis and on said barrel near said lower stationary axis.

4. A ladle turntable, as claimed in claim 1, wherein said ladle is lifted by means of a single jack arranged in the vertical mid-plane of said chair and bearing at a center of said transverse frame.

5. A ladle turntable, as claimed in claim 1, wherein each said at least one lifting jack is associated with a means for weighing said ladle.

6. A ladle turntable as claimed in claim 5, wherein said means for weighing said ladle comprises at least one balance interposed between said at least one lifting jack and said barrel.

7. A ladle turntable as claimed in claim 5, wherein said ladle is weighed on the basis of direct measurement of the pressure of said at least one lifting jack.

8. A ladle turntable as claimed in claim 1, wherein first and second elements of each said at least one lifting jack bear respectively on said barrel and on said transverse frame of the supporting chair by means of bearing members articulated at least about an axis parallel to the axes of articulation of the deformable parallelogram.

9. A ladle turntable as claimed in claim 1, wherein each said at least one lifting jack comprises a first element rigidly fastened to said barrel and a second element bearing on said chair by means of a compression connecting rod articulated at two ends thereof.

10. A ladle turntable as claimed in claim 9, wherein said compression connecting rod passes with play into a bore in an axis of a rod of said jack, so as to bear directly on a piston of said jack.

* * * * *